US006766135B2

(12) United States Patent
Wang et al.

(10) Patent No.: US 6,766,135 B2
(45) Date of Patent: Jul. 20, 2004

(54) TONER CARTRIDGE

(76) Inventors: Jui-Chi Wang, No. 50, Tzu-Chiang Rd., Wu-Chi Town, Taichung County (TW); Robin Hsu, No. 50, Tzu-Chiang Rd., Wu-Chi Town, Taichung County (TW); Ya-Li Huang, No. 50, Tzu-Chiang Rd., Wu-Chi Town, Taichung County (TW); Li Kuan Tung, No. 5o, Tzu-Chiang Rd., Wu-Chi Town, Taichung County (TW)

( * ) Notice: Subject to any disclaimer, the term of this patent is extended or adjusted under 35 U.S.C. 154(b) by 74 days.

(21) Appl. No.: 10/128,390

(22) Filed: Apr. 22, 2002

(65) Prior Publication Data

US 2003/0198488 A1 Oct. 23, 2003

(51) Int. Cl.[7] ..... G03G 15/08
(52) U.S. Cl. ..... 399/262; 222/DIG. 1
(58) Field of Search ..... 399/252, 258, 399/262, 119, 120; 141/346; 222/DIG. 1, 167, 325

(56) References Cited

U.S. PATENT DOCUMENTS 5,528,349 A * 6/1996 Satake ..... 399/262
5,867,757 A * 2/1999 Okazaki et al. ..... 399/262
6,256,469 B1 * 7/2001 Taniyama et al. ..... 399/258
6,298,208 B1 * 10/2001 Kawamura et al. ..... 399/262
6,370,349 B2 * 4/2002 Tsuji et al. ..... 399/262

* cited by examiner

*Primary Examiner*—Hoan Tran

(57) ABSTRACT

A toner cartridge is constructed to include a container for accommodating toner, the container having a filling hole portion disposed at one end for filling of toner into the container and a barrel with a discharging hole at an opposite end for output of toner to a toner-receiving container in the image forming system in which the toner cartridge is installed, a strippable seal attached to the barrel to seal the discharging hole, and a stopper coupled to the barrel and moved to close/open the discharging hole after removal of the seal from the barrel.

7 Claims, 3 Drawing Sheets

TONER CARTRIDGE

BACKGROUND OF THE INVENTION

1. Field of the Invention

The present invention relates to a toner cartridge for replenishing toner into an image forming apparatus and, more particularly, to a toner cartridge opening control arrangement for controlling the opening of the toner supply opening of the toner cartridge.

2. Description of the Related Art

A toner cartridge for use in an image forming system, such as a copying machine, a facsimile or a printer, for supplying a toner for forming an image with the toner is generally comprised of a cylindrical container and a cap. The container has an opening portion for filling of toner into the container as well as for discharging of toner from the container to the toner-receiving container in the image forming system. The cap is adapted for closing the opening portion. When in use, the cap is removed from the container, and then the container is loaded in the image forming system. After toner used up, the container must be removed from the image forming system for a replacement. However, residual toner may fall out of the empty container over the mechanical parts of the image forming system and the floor when taking the empty container out of the image forming system.

SUMMARY OF THE INVENTION

The present invention has been accomplished to provide a toner cartridge, which eliminates the aforesaid drawbacks. It is one object of the present invention to provide a toner cartridge, which has means to close/open the toner-discharging hole, preventing scattering of residual toner after removal of the toner cartridge from the image forming apparatus. To achieve this and other objects of the present invention, the toner cartridge comprises a cylindrical container for accommodating a toner, the container comprising a spiral groove extended around the periphery thereof, a filling hole portion disposed in a first end thereof through which the toner is filled into the container, and a barrel axially extended from a second end thereof, the barrel having a discharging hole for output of the toner to a toner-receiving container in the image forming system; a strippable seal adhered to the barrel to seal the discharging hole; and a stopper coupled to the barrel and moved between a first position where the stopper closes the discharging hole after removal of the seal from the barrel, and a second position where the stopper is moved away from the discharging hole and the discharging hole is opened after removal of the seal from the barrel.

DETAILED DESCRIPTION OF THE PREFERRED EMBODIMENT

Figure 1:
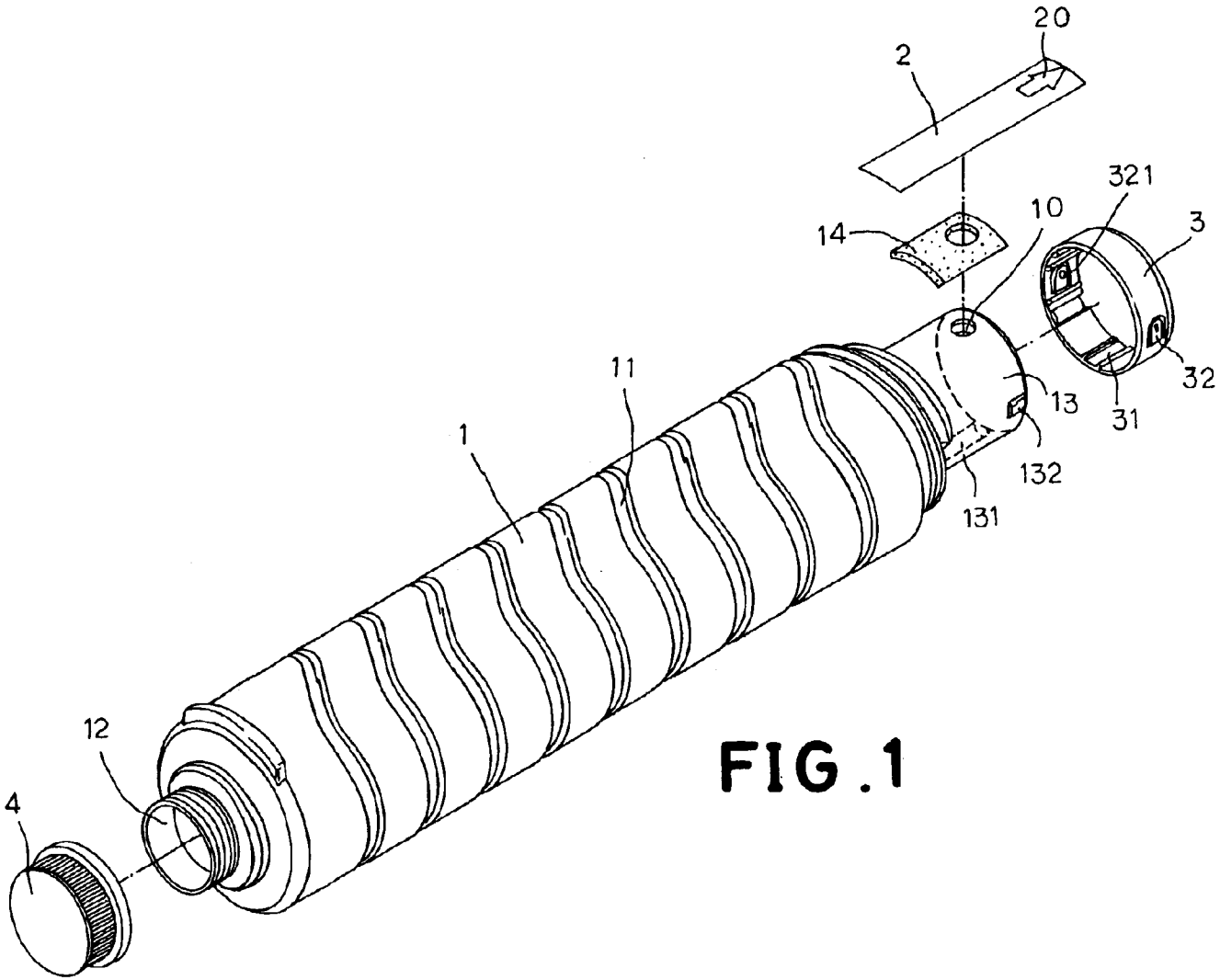
FIG. 1 is an exploded view of a toner cartridge according to the present invention.
Figure 2:
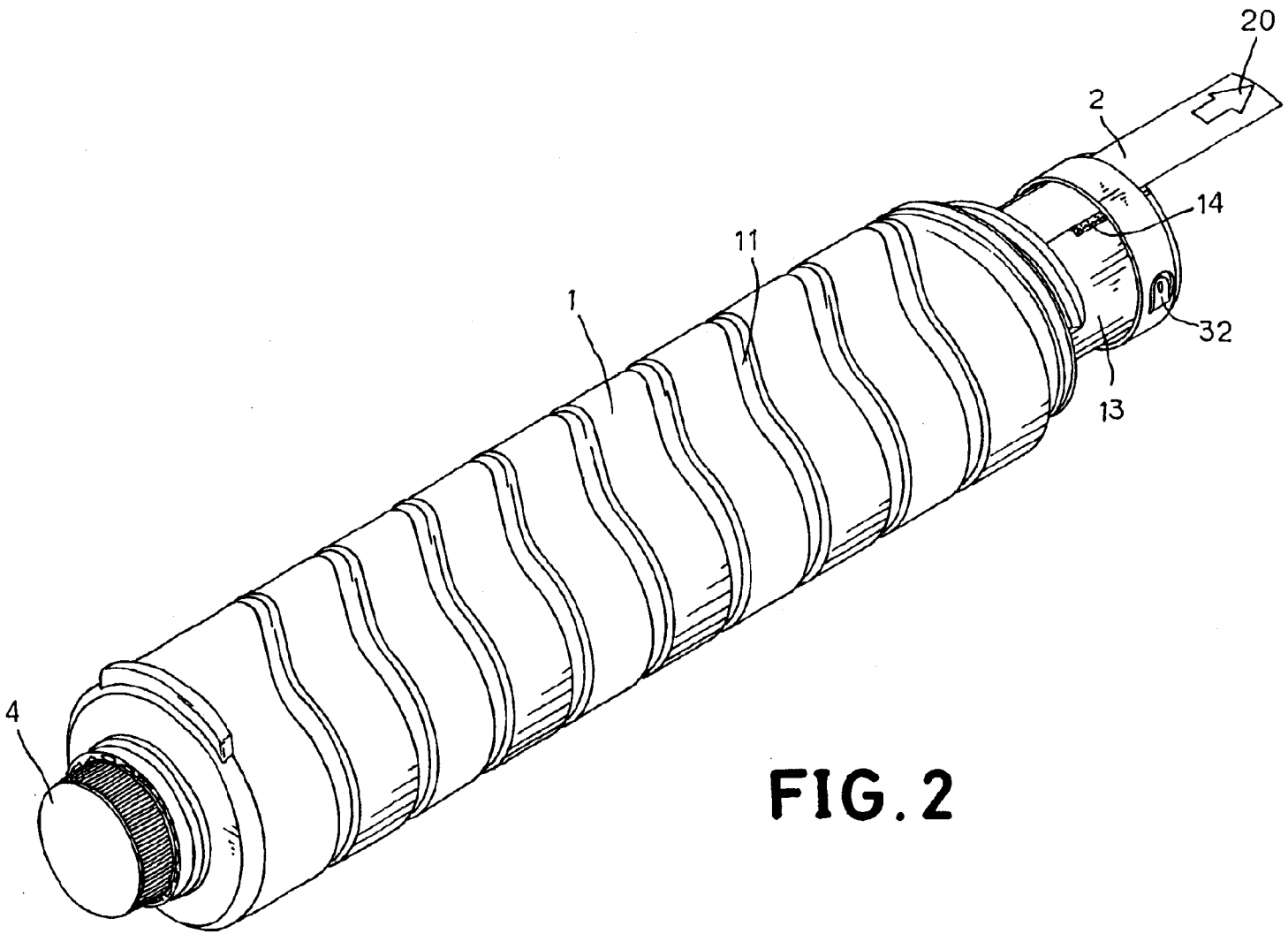
FIG. 2 is an elevational assembly view of the toner cartridge according to the present invention.

Referring to FIGS. 1 and 2, a toner cartridge in accordance with the present invention is shown comprised of a cylindrical container 1 for accommodating toner, a seal 2, a stopper 3, and an end cap 4.

The container 1 comprises a spiral groove 11 extended around the periphery, an opening portion 12 disposed in one end for filling of toner into the container 1 and detachably covered with the cap 4, and a barrel 13 axially extended from the other end. The barrel 13 has a discharging hole 10 for output of toner from the container 1 to the image forming system in which the toner cartridge is installed, a rail 131 longitudinally extended in the periphery, and at least one stop block (for example, two stop blocks) 132 protruded from the periphery. The seal 2 is a thin film of plastics adapted for sealing the discharging hole 10 of the barrel 13. After removal of the seal 2 from the barrel 13 of the container 1, the discharging hole 10 is opened for output of toner from the container 1 to the toner-receiving container in the image forming system. The stopper 3 is an annular member fitted onto the periphery of the barrel 13 and moved between two positions, namely, the close position where the stopper 3 closes the discharging hole 10, and the open position where the stopper 3 is opened from the discharging hole 10. The stopper 3 comprises a guide track 31 axially extended in the inner diameter and coupled to the rail 131 for guiding axial movement of the stopper 3 along the rail 131 between the close position and the open position, and at least one springy pressure strip (for example, two springy pressure strips) 32 protruded from the peripheral wall corresponding to the at least one stop block 132 of the barrel 13. Each springy pressure strip 32 has a protruded portion 321 disposed at an inner side.

Referring to FIGS. 1 and 3 again, a gasket pad 14 is sealed to the periphery of the barrel 13 around the discharging hole 10 to prevent leakage of toner when the stopper 3 moved to the close position to close the discharging hole 10.

Referring to FIGS. from 1 through 3 again, the seal 2 has one end terminating in a finger strip portion 20 suspending outside the barrel 13. The stopper 3 is sleeved onto the barrel 13 over the seal 2 and the gasket pad 14, forcing the guide track 31 into coupling with the rail 131. During mounting of the stopper 3 onto the barrel 13, the springy pressure strips 32 are respectively radially forced outwards for enabling the stopper 3 to pass over the stop blocks 132. When loaded, the springy pressure strips 32 return to their former shape (due to the effect of their springy material property). When moving the stopper 3 outwards, the protruded portions 321 of the springy pressure strips 32 will be stopped by the stop blocks 132 of the barrel 13, preventing the stopper 3 from falling out of the barrel 13. When moved to the close position, the friction resistance between the inner diameter of the stopper 3 and the gasket pad 14 holds the stopper 3 positively in position. After filling of toner into the container 1 through the opening portion 12. The end cap 4 is fastened to the opening portion 12 to close the passage.

When in use, the toner cartridge is put in the image forming system. At this time, the push means of the image forming system pushes the stopper 3 inwards along the rail 131 from the close position to the open position. After removal of the seal 2, the discharging hole 10 is opened for output of toner from the container 1 to the toner-receiving container of the image forming system.

Figure 3:
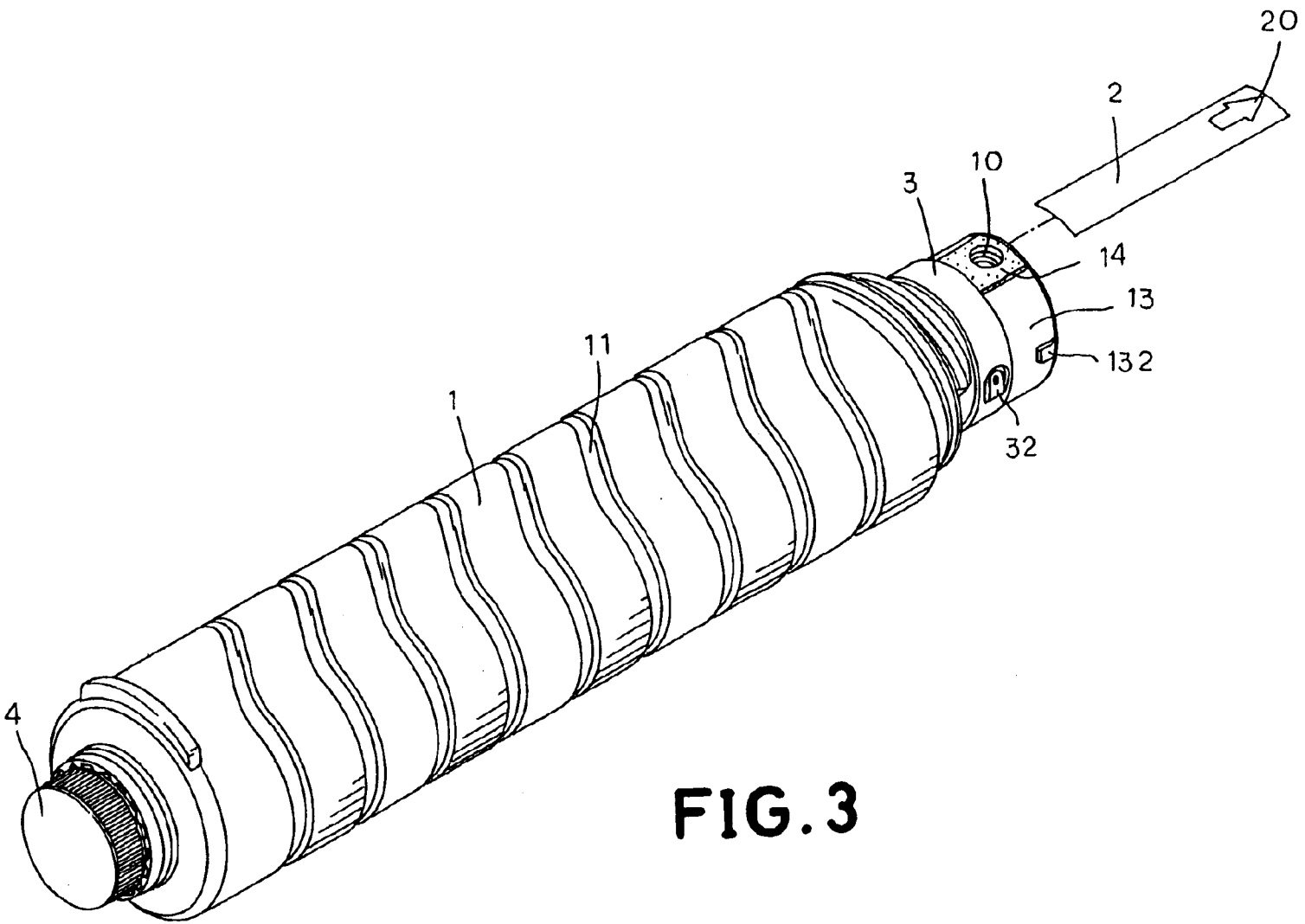
FIG. 3 is similar to FIG. 2 but showing the seal detached from the cover.

A prototype of toner cartridge has been constructed with the features of FIGS. 1–3. The toner cartridge functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A toner cartridge used in an image forming system for supplying a toner for forming an image with said toner, said toner cartridge comprising:

a cylindrical container for accommodating said toner, said container comprising a spiral groove extended around the periphery thereof, a filling hole portion disposed in a first end thereof through which said toner is filled into said container, and a barrel axially extended from a second end thereof, said barrel having a discharging hole for output of said toner to a toner-receiving container in said image forming system;

a removable seal adhered to said barrel to seal said discharging hole only during storage and transport, said removable seal being removed from said discharging hole when said toner cartridge is installed in said image forming system; and a stopper coupled to said barrel and moved between a first position where said stopper applies pressure to a stationary gasket pad so that said stopper and said gasket pad seal said discharging hole after removal of said removable seal from said barrel, and a second position where said stopper is moved away from said discharging hole and said discharging hole is opened after removal of said removable seal from said barrel.

2. The toner cartridge as claimed in claim 1, wherein said strippable seal is a thin film of plastic.

3. The toner cartridge as claimed in claim 1, wherein said barrel of said container comprises a rail adapted for guiding movement of said stopper between said first position and said second position.

4. The toner cartridge as claimed in claim 3, wherein said stopper comprises a track coupled to said rail of said barrel for guiding movement of said stopper along said rail between said first position and said second position.

5. The toner cartridge as claimed in claim 4, wherein said barrel comprises at least one stop block respectively protruded from the periphery thereof and adapted for stopping said stopper from falling out of said barrel.

6. The toner cartridge as claimed in claim 5, wherein said stopper comprises at least one springy pressure strip respectively protruded from the periphery thereof corresponding to the at least one stop block of said toner cartridge, said springy pressure strip each having a protruded portion disposed at an inner side, which is stopped at one stop block of said barrel when said stopper moved to said first position.

7. The toner cartridge as claimed in claim 1, further comprising an end cap fastened to said filling hole portion of said container.

* * * * *